US005356013A

United States Patent [19]

Deioma et al.

[11] Patent Number: 5,356,013

[45] Date of Patent: Oct. 18, 1994

[54] SKI AND BOOT BAG

[76] Inventors: David M. Deioma; David B. Deioma, both of 35 Greentree Rd., Chagrin Falls, Ohio 44022

[21] Appl. No.: 123,450

[22] Filed: Sep. 17, 1993

[51] Int. Cl.[5] ..... A45C 3/00; B65D 85/00

[52] U.S. Cl. ..... 206/579; 190/109; 190/111; 206/315.1; 224/202; 224/917

[58] Field of Search ..... 190/109–111; 206/315.1, 579; 224/917, 202

[56] References Cited

U.S. PATENT DOCUMENTS

| | | | |
|---|---|---|---|
| D. 305,831 | 2/1990 | Vanderhorst . | |
| 3,336,961 | 10/1954 | Welsh . | |
| 3,767,036 | 10/1973 | McLeod . | |
| 3,830,348 | 8/1974 | Ohyama | 190/110 |
| 3,917,137 | 11/1975 | Willkins . | |
| 4,191,233 | 3/1980 | McKay . | |
| 4,358,137 | 11/1982 | Gramm . | |
| 4,715,416 | 12/1987 | Horne . | |
| 4,746,159 | 5/1988 | Webb et al. . | |
| 4,856,689 | 8/1989 | Shore . | |
| 5,012,921 | 5/1991 | Becker . | |
| 5,060,767 | 10/1991 | Pulichino, Jr. et al. | 190/111 |
| 5,105,919 | 4/1992 | Bomes et al. | 190/111 |

FOREIGN PATENT DOCUMENTS

| | | | |
|---|---|---|---|
| 2013813 | 10/1971 | Fed. Rep. of Germany . | |
| 0987540 | 8/1951 | France | 206/315.1 |
| 0401496 | 11/1933 | United Kingdom | 190/111 |

*Primary Examiner*—Jimmy G. Foster

*Attorney, Agent, or Firm*—Pearne, Gordon, McCoy & Granger

[57] ABSTRACT

A combination ski and boot bag including an elongated generally tubular shaped main portion for holding skis and ends on the main portion, a zipper along at least part of the length of the main portion allows access to the inside. A strap has ends attached to the main portion and has a support area near about one-half the length of the main portion. At least two satellite boot compartments are connected to the outside of the main portion and are spaced from each other and generally equally spaced from the support area of the strap along the length of the ski bag. The satellite boot compartments having closures which permit the boots to the placed therein and removed. The bottoms of the satellite boot compartments are generally on the same plane near the bottom side of the bag so that boots will stand up when in the satellite boot compartments and set on a horizontal surface.

14 Claims, 1 Drawing Sheet

SKI AND BOOT BAG

BACKGROUND OF THE INVENTION

1. Field of the Invention

This invention relates generally to a luggage bag and in particular to a ski bag with satellite compartments, which when uniformly loaded may be carried in a balanced fashion by its carrying means.

2. Brief Description of the Prior Art

Travel with ski equipment is at best cumbersome. Multiple bags are usually required to transport skis and ski boots. Carrying the multiple bags particularly at airports tends to be unwieldy and frustrating. The task of transporting all of the bags to a bus, car, hotel or airline counter usually means multiple trips or paying a porter.

Combination ski and boot bags do exist but all of them have drawbacks. For example, U.S. Pat. No. 4,746,159 uses a central portion of the ski bag for holding the boots. The central portion thus becomes very balky. When the carrying strap of the ski and boot holder of the '159 patent is put over a shoulder the weight of the bag would extend outwardly and away from the vertical center axis of the carrier's body. The carrier would thus have to walk in an unbalanced and uncomfortable manner.

Another combination bag is shown in U.S. Pat. No. 4,358,137 which includes wheels and a frame to support a ski and boot bag. When empty the bag would still require substantial space to store the wheels and frame. Moreover, because ski bags often have to be lifted, the wheels and frame would make that task more difficult.

U.S. Pat. No. 3,767,036 describes a rigid combination ski and boot carrying case. A rigid case presents a problem of storage at ski slopes where space is usually very limited. The '030 patent also does not address the proper distribution of weight to make the bag easier to carry. All of the above-noted patents are incorporated here by reference.

There is a need for and this invention provides a combination bag with satellite compartments which can be easily loaded and transported. The bag balances and is easy to carry when loaded so that the burden of transporting it is made as convenient as possible. The bag is also foldable when empty so that it can be stored in a minimum amount of space.

SUMMARY OF THE INVENTION

This invention includes a luggage bag including a main generally tubular portion and ends on the main portion. The main portion has a length greater than its circumference. A carrying means is fastened along the main portion of the body. A closure means on the luggage bag allows access to load and unload it. At least two satellite compartments are attached to the main portion of the bag, spaced from each other longitudinally along the length of the bag and approximately equidistant from the center of gravity of the bag when it is loaded.

BRIEF DESCRIPTION OF THE DRAWINGS

The present invention will be more fully described hereafter, with reference to the drawing figures, wherein.

DETAILED DESCRIPTION OF THE INVENTION

Figure 1:
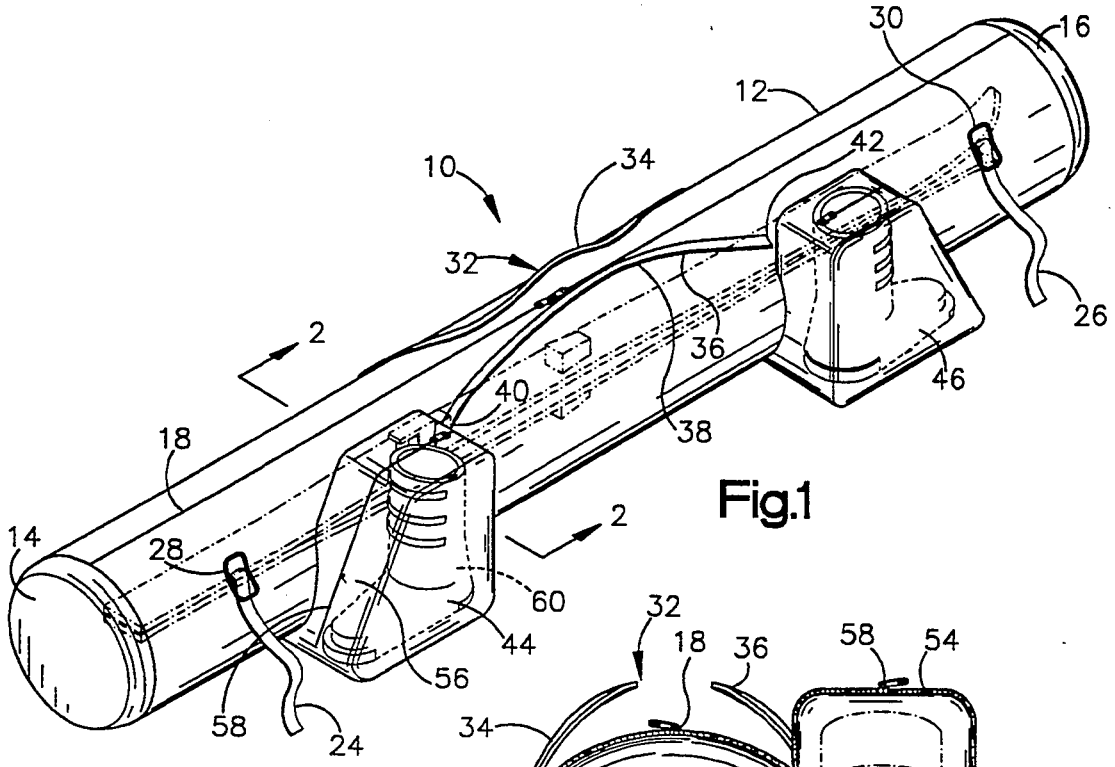
FIG. 1 is a perspective view of the ski and boot bag of this invention.
Figure 2:
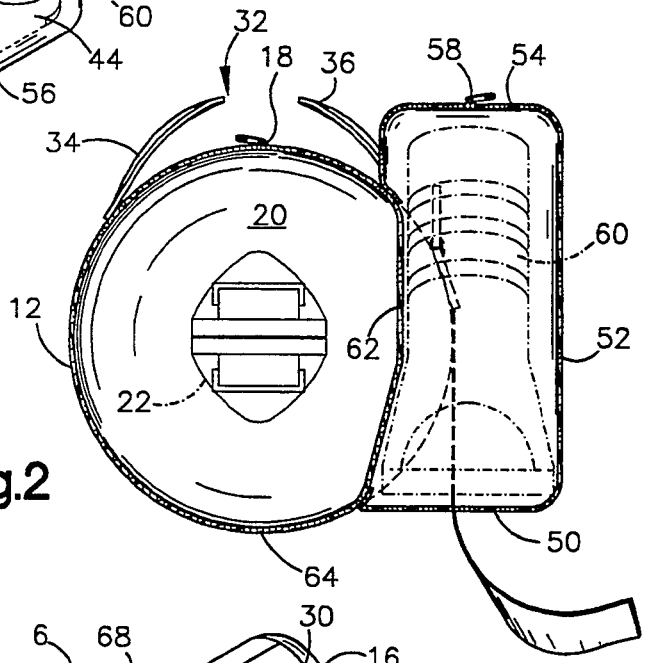
FIG. 2 is a section 2—2 taken of FIG. 1.

As particularly noted in FIGS. 1 and 2, there is a combination ski and boot bag 10. It includes a generally tubular main portion 12 having ends 14 and 16 attached thereto. The main section 12 and ends 14 made be made of any suitable soft or hard material known in the art. Reinforced nylon or blends of material such as Cordura as commonly used. The cross section of the main portions may be any shape but is generally circular or at least rounded. The ends 14 and 16 may be attached to the main portion in any suitable manner such as sewing, heat sealing and the like. The main portion 12 normally has length greater than its circumference. The "ends" as used herein do not have to be a separate piece of material. The main portion may just have its ends closed by sewing on the like.

Figure 3:
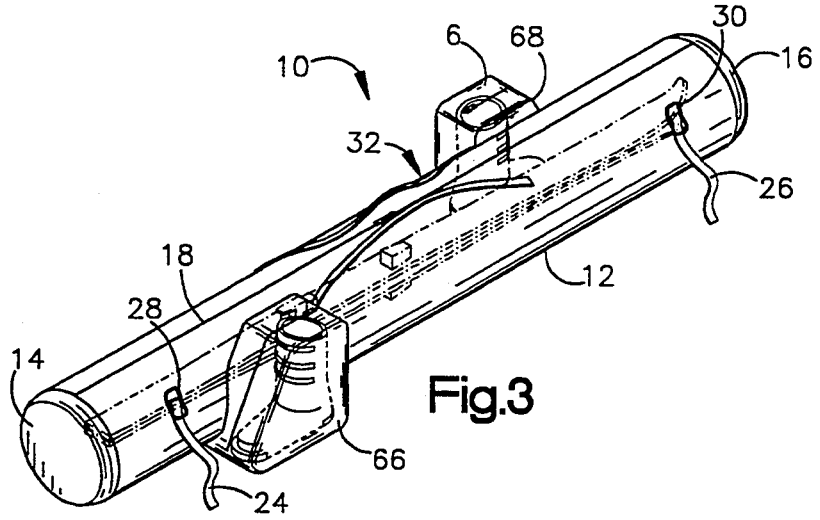
FIG. 3 is an alternate embodiment of the ski and boot bag of FIG. 1.

A closure means 18 along at least a portion of the combination bag allows access to the inside 20 of the main portion 12. The closure means is normally a zipper but may be any type of device that can be repeatedly opened and closed. The closure means may be the full length of the main portion 12 as shown in FIG. 1 and 3 or part of the main portion or at one or both of the ends 14 and 16. Skis 22 with bindings are shown in FIG. 2 as they would normally be positioned and in phantom in FIGS. 1 and 3. Inside ties (not shown) are commonly used to hold the skis in position. Ski poles and other articles may also be placed in the main portion 12.

Exterior binding straps 24 and 26 having buckles 28 and 30 are used to tighten all of the contents together in the main portion 12 once the bag is loaded.

A carrying means 32 is provided to pick up and/or transport the combination bag 10. The carrying means 32 will frequently be a pair of flexible straps 34 and 36. However, the carrying means 32 may be a simple, rigid or soft, handle of any kind. A support area 38, which will normally be the center of straps 34 and 36 is the location where the loaded bag may be balanced. The support area may vary somewhat from the center of the straps if the bag is unevenly weighted. The straps 34 and 36 should preferably have a length so that they may rest on person's shoulders while the main portion 12 would be positioned generally at the waist area. In this manner the combination bag would extend laterally a minimum amount from a person's body carrying the bag.

The ends 40 and 42 of the strap 36 are fastened at or near compartments 44 and 46. The strap 34 will be similarly fastened but is not shown. In this manner the load carried by the satellite compartments may be partially supported by the straps 34 and 36. This configuration also gives better control and stability both longitudinally and laterally to the load carried by the combination bag by the carrying means 32.

The satellite compartments 44 and 46 may be of different shapes and locations on the main portion 12. In the preferred embodiments of FIGS. 1 and 3, they are spaced apart from each other along the length of the main portion 12. They are also spaced about equidistant from the center of the bag on the support area 38 of the carrying means 32. By "about equidistant" it is meant that the satellite compartments are positioned so that when they are generally equally loaded the bag will be substantially balanced at the support area 38 of the carrying means 32. The term equidistant is not used in the strict scientific sense. It is used in the sense of positioning the compartments 44 and 46 so that the entire load of the combination bag 10 may be carried in a convenient generally balanced manner with a minimum of effort. In this respect one compartment may actually be placed at a somewhat different location than the other relative to the center or ends of the main portion 12.

Each of the satellite compartments 44 and 46 has similar parts but only 44 will be described. The satellite compartment 44 has a bottom portion 50, an exterior 52, top 54, and face 56. Bottom portion 50 is used herein in the sense that the bottom of the boot actually rests on it. A closure 58, normally a zipper, allows access to the satellite compartment 44 so that it can be conveniently loaded and unloaded. The closure 58 can be placed on other areas of the satellite compartment including an interior section 62 of the compartment facing the main section 12.

It should be noted that the bottom portion 50 is generally complaner with a tangent to what is shown as the bottom 64 of the bag. The term bottom of the bag is used in the sense that it is the part of the main portion on the other side of the carrying means 32. The term coplaner is used in a general sense since the compartments are normally soft material. What is important is that the bottom portions of both satellite compartments when loaded lay flat on a horizontal surface such as a floor. In this manner the combination bag when loaded with skis and boots is stable when set down and the carrying means is always conveniently on the top.

The embodiment of FIG. 1 has particular advantages of balance and convenience. Because the bag 10 is designed to be carried at a person's side with the straps over a shoulder on the same or opposite side as the bag, the satellite compartments will be in front and back of the person. Moreover, the satellite bags will project inwardly near the vertical center axis of the person's body. The weight in the satellite bags will thus have very little if any tendency to pull the person carrying it sideways. When loaded, the bag 10 is roughly like a balanced yoke and can thus be carried easier and for longer distances without tiring.

Convenience is also a factor of the FIG. 1 embodiment. Because the satellite compartments 44 and 46 will be carried toward the vertical center axis of a person, only the width of the main portion 12 extends outwardly. Thus a person can more easily pass through narrow doorways and the like of buildings and vehicles.

The combination bag of FIG. 3 is similarly balanced fore and aft when loaded but it has its satellite compartments 66 and 68 placed on opposite sides of the main portion 12. This configuration has the advantage of being extremely stable when it is set down on a horizontal surface. Because the boots are on opposite sides of the main portion, it is very unlikely that the combination bag would be knocked over.

While the combination bag has been described relative to skis and boots it should be noted that it has broader applications for carrying any kind of load. It should also be noted that more than two satellite bags could be used on each bag. The main portion could also be sized to carry clothes in addition to or instead of skis.

While the preferred embodiments of the present invention are shown and described herein, it is to be understood that the same is not so limited but shall cover and include any and all modifications thereof which fall within the purview of the invention.

What is claimed is:

1. A luggage bag including a main general tubular portion and ends on the main portion, the main portion having a length greater than its circumference, a carrying means fastened along the main portion of the bag;

the carrying means having a support area so that the luggage bag when generally evenly loaded is adapted to be generally balanced when supported at the support area;

a closure means on the luggage bag for allowing opening and closing of the bag in order to load and unload it;

at least two satellite compartments attached to the main portion of the luggage bag, spaced from each other along the length of the bag, the spacing of satellite compartments being at least the width of one of its ends of the main portion so that a person carrying the bag at the support area will be generally longitudinally offset from the satellite compartments so that the person will not abut against any of the compartments.

2. The luggage bag of claim 1 wherein the satellite compartments are generally spaced about equidistant from the support area of the carrying means but in different longitudinal directions from it so that when the luggage bag and satellite compartments are relatively uniformly loaded that bag will be balanced when held at the support area.

3. The luggage bag of claim 1 wherein the main portion has a length and circumference sufficient to hold a pair of skis and each satellite compartment is sufficiently large to hold a ski boot.

4. The luggage bag of claim 3 wherein the satellite compartments have a back portion, a bottom portion, a front face and a closure to allow a ski boot to be placed therein.

5. The luggage bag of claim 4 wherein the main portion and satellite compartments are made of soft material which may be folded into a small package when it is empty.

6. The luggage bag of claim 4 wherein the closure means on the bag is a zipper along at least part of the length of the main portion.

7. The luggage bag of claim 3 wherein inside bottom portions of the satellite compartments are adapted to receive the bottom of a ski boot, the bottom portion of the satellite compartments being generally on the same level with a bottom portion of the luggage bag so that when ski boots are placed in the satellite compartments they will stand up when laid on a horizontal surface.

8. The luggage bag of claim 7 wherein the satellite compartments are attached to the main portion on the same side of the support area of the holding means.

9. The luggage claim of claim 8 wherein the holding means is at least one strap having its ends attached to the main portion and having a length sufficient to be carried on a person's shoulder whereby one of the satellite compartments would be in front of and toward the center vertical axis of the person's body and the other satellite compartment would be behind and toward the center vertical axis of the person's body.

10. The luggage bag of claim 7 wherein the satellite bags are attached to the main portion on opposite sides of the support area of the holding means.

11. The luggage bag of claim 3 wherein the holding means is at least one strap, and the strap has its ends attached the main portion and to the satellite compartments so that a load is substantially balanced when the strap is held at its center.

12. The luggage claim of claim 11 wherein the strap has a length sufficient to be carried on a person's shoulder whereby one of the satellite compartments would be in front of the person and one would be behind him in a balanced fashion.

13. A combination ski and boot bag comprising:

an elongated generally tubular shaped main portion for holding skis;

ends on the main portion;

a closure along at least part of the main portion;

a carrying means having a support area near an area at about one-half the length of the main portion;

at least two satellite boot compartments connected to the outside of the main portion, the satellite boot compartments being spaced from each other and generally spaced about equidistant from the support area along the length of the main portion;

the satellite boot compartments having a closure to allow boots to be placed therein;

the boot compartments further having a bottom portion located so that boots will stand up when in the boot compartment and set on a horizontal surface; and the space between the satellite boot compartments being at least as wide as the bottom portion of the boot compartment on which the boot rests so that a person carrying the bag by the support area will have his body longitudinally offset from the compartments so that the person does not abut against any of the compartments.

14. The combination ski and boot bag of claim 13 wherein:

the carrying means is a strap having its ends attached near the satellite boot compartments and long enough to be carried over a person's shoulder; and the satellite boot compartments are on the same side of the holding means and are spaced apart from enough to allow a person's body that is carrying the bag to fit between them, thus distributing the weight of skis and boots therein evenly from front to back of the person and having the boots close to the person's vertical axis.

* * * * *

UNITED STATES PATENT AND TRADEMARK OFFICE

CERTIFICATE OF CORRECTION

PATENT NO. : 5,356,013

DATED : October 18, 1994

INVENTOR(S) : David M. Deioma and David B. Deioma

It is certified that error appears in the above-identified patent and that said Letters Patent is hereby corrected as shown below:

Column 6,

Claim 14, line 7, "from" should be --far--.

Signed and Sealed this

Twenty-eight Day of March, 1995

*Attest:*

Bruce Lehman

BRUCE LEHMAN

*Attesting Officer*

*Commissioner of Patents and Trademarks*